US008418282B2

(12) United States Patent
Luft-Weissberg

(10) Patent No.: US 8,418,282 B2
(45) Date of Patent: Apr. 16, 2013

(54) FOLD UP DORMITORY APPARATUS, SYSTEM AND METHOD

(76) Inventor: Michael E. Luft-Weissberg, Niskayuna, NY (US)

( * ) Notice: Subject to any disclaimer, the term of this patent is extended or adjusted under 35 U.S.C. 154(b) by 381 days.

(21) Appl. No.: 12/978,827

(22) Filed: Dec. 27, 2010

(65) Prior Publication Data

US 2011/0088163 A1 Apr. 21, 2011

Related U.S. Application Data

(60) Provisional application No. 61/290,869, filed on Dec. 29, 2009.

(51) Int. Cl.
*A47B 83/00* (2006.01)

(52) U.S. Cl.
USPC ..... 5/2.1; 5/133; 5/136; 5/159.1; 312/235.2; 312/235.4; 312/237; 312/313; 312/315; 312/317.3; 312/283; 312/285; 108/33; 108/34; 108/35; 108/36; 108/38; 108/42; 108/48

(58) Field of Classification Search ..... 5/234, 306, 5/346, 399, 412, 434; 312/235.2, 235.4, 312/237, 313, 315, 317.3, 283, 285; 108/33, 108/34, 35, 36, 38, 48, 42
See application file for complete search history.

(56) References Cited

U.S. PATENT DOCUMENTS 23,604 A * 4/1859 Payne et al. ..... 5/2.1
394,806 A * 12/1888 Augier ..... 312/325
445,777 A * 2/1891 Goodwillie ..... 5/2.1
487,685 A * 12/1892 Snyder ..... 5/2.1
517,458 A * 4/1894 Hopkins ..... 5/2.1
915,651 A * 3/1909 Appel ..... 5/158
1,245,582 A * 11/1917 Gray ..... 312/225
1,612,132 A * 12/1926 Lannom ..... 312/315
1,990,959 A * 2/1935 Saperstein ..... 5/155
2,566,256 A * 8/1951 Snyder ..... 108/33
2,671,230 A * 3/1954 Potter ..... 5/141
2,672,624 A * 3/1954 Giuseffi ..... 5/2.1
2,692,812 A * 10/1954 Stahl ..... 312/310
2,770,813 A * 11/1956 Marzillier ..... 5/2.1
3,088,127 A * 5/1963 Eames ..... 5/2.1
3,423,772 A * 1/1969 Mainguy ..... 5/2.1
(Continued)

OTHER PUBLICATIONS

Luft-Weissberg, Michael E.; Final Class Project Presentation; University of Massachussets at Amherst; May 26, 2009.

*Primary Examiner* — Robert G Santos
*Assistant Examiner* — Ifeolu Adeboyejo
(74) *Attorney, Agent, or Firm* — Jay R. Yablon

(57) ABSTRACT

"The Fold Up Dormitory" is intended for use in situations where living and working quarters for a small or large number of people are required on short notice or irregular intervals. The apparatus is made of wood, steel and premanufactured hardware, and comprises components for sleeping, working and storage of small items. It is mobile, simple to operate and offers many options to those who use it. The apparatus comprises: a central core; a pair of folding frames, each pivotally connected to the central core on opposite sides thereof, for rotation about vertical frame-to-core axes of connection; a bed platform pivotally connected to a first side of the central core, for rotation about a horizontal bed-to-core axis of connection; a desk surface pivotally connected to a second side of the central core, for rotation about a horizontal desk-to-core axis of connection; and storage shelving within the central core.

23 Claims, 5 Drawing Sheets

U.S. PATENT DOCUMENTS 3,537,769 A * 11/1970 Di Carlo ..... 312/277
3,540,788 A * 11/1970 Lundquist ..... 312/237
3,596,297 A * 8/1971 James ..... 5/2.1
3,660,591 A * 5/1972 Schultz et al. ..... 174/70 R
3,866,365 A 2/1975 Honigman
3,965,498 A * 6/1976 Boni ..... 5/6
4,070,715 A 1/1978 Reppas
4,084,276 A 4/1978 Trexler, Jr. et al.
4,103,373 A 8/1978 Luedtke et al.
4,958,874 A 9/1990 Hegedus
4,999,865 A 3/1991 Sauder et al.
5,101,523 A * 4/1992 Bright ..... 5/2.1
5,147,122 A * 9/1992 Short ..... 312/321.5
5,446,932 A * 9/1995 Voorhis ..... 5/137
5,806,248 A * 9/1998 Kim ..... 52/36.1
5,875,502 A 3/1999 Kolbenstetter et al.
5,913,769 A 6/1999 Byma et al.
5,940,911 A 8/1999 Wang
6,088,849 A * 7/2000 Lieber ..... 5/2.1
6,212,710 B1 * 4/2001 Jones ..... 5/118
6,401,276 B1 * 6/2002 Sherman ..... 5/136
6,508,526 B2 1/2003 Reppas et al.
6,574,807 B1 * 6/2003 Gonzalez ..... 5/159.1
6,779,208 B2 * 8/2004 Lim et al. ..... 5/136
2005/0166318 A1 * 8/2005 Bokser ..... 5/308
2006/0230530 A1 * 10/2006 Avishay ..... 5/136
2006/0260045 A1 * 11/2006 Stonier ..... 5/133
2006/0282945 A1 * 12/2006 Gallawa et al. ..... 5/2.1
2007/0251165 A1 * 11/2007 Kern et al. ..... 52/173.1
2008/0229497 A1 * 9/2008 Paoutoff ..... 5/136
2009/0126605 A1 * 5/2009 Petty ..... 108/42
2012/0161597 A1 * 6/2012 Daniels et al. ..... 312/237

* cited by examiner

FOLD UP DORMITORY APPARATUS, SYSTEM AND METHOD

CROSS-REFERENCE TO RELATED APPLICATIONS

This application claims benefit from provisional application U.S. 61/290,869 filed Dec. 29, 2009.

BACKGROUND OF THE INVENTION

When people suddenly become displaced from their homes in disaster situations, or when there is an excess of people in a given location that cannot accommodate enough inhabitants, there is a often a need to provide living and working quarters for an unknown amount of time. Often, school gymnasiums or auxiliary rooms in dormitory buildings are converted into living quarters, with sleeping cots or surplus furniture set up to accommodate the basic needs of large numbers of people. When those people are displaced for long periods of time, or in situations where long-term accommodations demand needs for daily living beyond sleeping, such accommodations may not be suitable.

The prior art shows a number of fold-up living spaces and multi-functional devices, but these are not suitable for providing the necessary accommodations mentioned above, with suitable flexibility, utility, and compactness for storage.

U.S. Pat. No. 3,866,365, for example, appears to disclose a mobile enclosure, much like a "pop-up" tent used for camping. The patent itself deals mostly with the spring and hinged mechanisms used to open and close the floor and ceiling panels that unfold to enclose a small space. This invention is meant to be hauled around as a vehicle trailer, and it merely provides space without any particular functionality to meet daily living needs.

U.S. Pat. No. 4,070,715 appears to disclose a bed/sleeping platform, a desk, and storage. The height of the bed is considered as a fundamental design feature and the mechanism involved in raising and lowering the bed platform changes the height of the desk when the bed is flipped up and then lowers the desk to allow the bed to rest at an optimal height. However, this invention only permits one usable height can only be used either as a bed, or as a desk, but not a bed and desk simultaneously. It would be desirable to provide both a bed and a desk for simultaneous use. Additionally, this device does not fold up compactly for storage and easy mobility when not in use. Additionally, this device is constructed as a box-like piece of furniture that inherently weighs more than is desirable for compact storage and easy portability, and comprises a series of rectangular frames made stiff with rigid "moment connections" at all corner connections that further highlight that this device cannot be compactly folded and stored. Fundamentally this device is a bed/desk convertible which does not permit simultaneous use of both bed and desk and which cannot be compactly folded for storage and easy movement.

U.S. Pat. No. 4,084,276 is an installation piece rather than a mobile unit and provides only an operable sleeping surface without portability. Similarly, U.S. Pat. Nos. 4,103,373 and 5,875,502 are for sleeping only, and are designed to save space for other functions in a room when not being used for sleeping. They do not provide multifunctional capability or portability, and are attached in a fixed location.

U.S. Pat. No. 4,958,874, like U.S. Pat. No. 3,866,365, is used to provide a flexible enclosed space for any number of functions, but does not provide specific sleeping and working functionality with that space. This device must be towed by a large vehicle and certainly cannot be moved by one individual human being without additional external power.

U.S. Pat. No. 4,999,865 contains a storage space, and unfolds to provide a sleeping platform. However, it does not have a distinct working surface or desk and is more like a storage cabinet with a compartment for a bed similar to many fold-out couches. When this device is collapsed it provides storage but not increased mobility since it remains a large wooden box sitting on the floor. It cannot be collapsed into a thin, substantially hexahedronal configuration and easily rolled away.

U.S. Pat. No. 5,913,769, for a combination bed and desk, is similar to U.S. Pat. No. 4,999,865, but it also contains a desk surface. This device, however, has a stationary desk surface that is unchanged by any deployment or storage of the sleeping surface, which does not at any time fold up for storage. Also, this device demands the displacement of the two large storage units before the bed can deploy. One must first change the singular desk unit into 3 separate parts disconnected from one other to enable its sleeping function. It does not remain connected as one cohesive unit throughout its transformation from compact upright box to deployed multifunctional dormitory, as would be desirable for efficient deployment for use and compaction for storage between uses.

U.S. Pat. No. 5,940,911 discloses an adjustable bed for rehabilitation or leisure purposes that, when deployed, gives access to some storage space. The sleeping platform is intended to be fully adjustable in terms of levelness, height, form and position, because of its intended use for rehabilitation purposes. A system that is not intended for such use can be greatly simplified. Importantly, this invention requires a mechanical motor to operate whereas it is desirable to enable operation for a foldable dormitory space with multiple utilitarian functions solely by human power, i.e., omitting any type of external power to convert between said closed configuration for storage and said open configuration for use, except as provided by a human being.

U.S. Pat. No. 6,401,276 contains a desk surface and a sleeping surface both of which can be stowed away for compactness. However, only the desk or sleeping surface can be used at any given time. They cannot be used simultaneously. This is evident because the desk actually provides the structural support for the bed platform. It is preferred to have the desk and the bed deploy and be available independently, for simultaneous use.

Finally, U.S. Pat. No. 6,508,526, for a convertible bed with computer desk, contains a desk/computer surface that can be deployed or hidden away, a sleeping platform that can be deployed and stowed, and variable storage space contained within the overall unit. However, the bed surface deploys by swinging down over the desk, work surface and storage space hence rendering them unusable. As with some of the previously cited prior art, this prohibits simultaneous use of all components while the device is in open and in use.

SUMMARY OF THE INVENTION

"The Fold Up Dormitory," is intended for use in situations where living and working quarters for a small or large number of people are required on short notice or irregular intervals. The Fold Up Dormitory is a device, preferably but without limitation, made of wood, steel and premanufactured hardware. However, a device which meets the functional requirements disclosed here, constructed with any materials whatsoever, is considered to fall within the scope of this disclosure and its associated claims irrespective of the particular choice of materials. The Fold Up Dormitory comprises components for sleeping, working and storage of small items. It is mobile, simple to operate and offers many options to those who use it.

This apparatus and associated method comprises: a central core; a pair of folding frames, each pivotally connected to the central core on opposite sides thereof, for rotation about vertical frame-to-core axes of connection; a bed platform pivotally connected to a first side of the central core, for rotation about a horizontal bed-to-core axis of connection; a desk surface pivotally connected to a second side of the central core, for rotation about a horizontal desk-to-core axis of connection; and storage shelving within the central core. This storage shelving may be detached and affixed to select other parts of the device.

When the apparatus is compacted into the closed configuration for storage, the central core, the frames, the bed platform, the desk surface, and the storage shelving are all are contained within a hexahedronal space—for a single bed unit (as opposed to double bed, queen bed, king bed, etc. units)—not exceeding 24" thick, 45" wide and 81" high. This is based fundamentally on the dimensional size of a standard single bed mattress, and will vary for other mattress sizes.

When the apparatus is expanded into the open configuration for use: the folding frames are attached to the central core on one side of the bed platform and the desk surface, and are oriented in a substantially vertical plane; the bed platform is attached to the first side of the central core and oriented in a substantially horizontal plane; the desk surface is attached to the second side of the central core and oriented in a substantially horizontal plane, and is simultaneously usable together with the bed platform; and the storage shelving is accessible for use simultaneously with the bed platform and the desk surface.

The apparatus is configured such that all of the folding frames, the bed platform and the desk surface remain pivotally connected to the central core without disconnection, while the apparatus is compacted into the closed configuration for storage, while the apparatus is expanded into the open configuration for use, and while the apparatus is converted between the closed configuration for storage and the open position for use.

In some varied embodiments, this apparatus also contains a secure locker for storage of small items, contains standard electrical outlets, and hooks to affix a privacy curtain between the extents of the unfolded rectangular supports.

DETAILED DESCRIPTION

Figure 1:
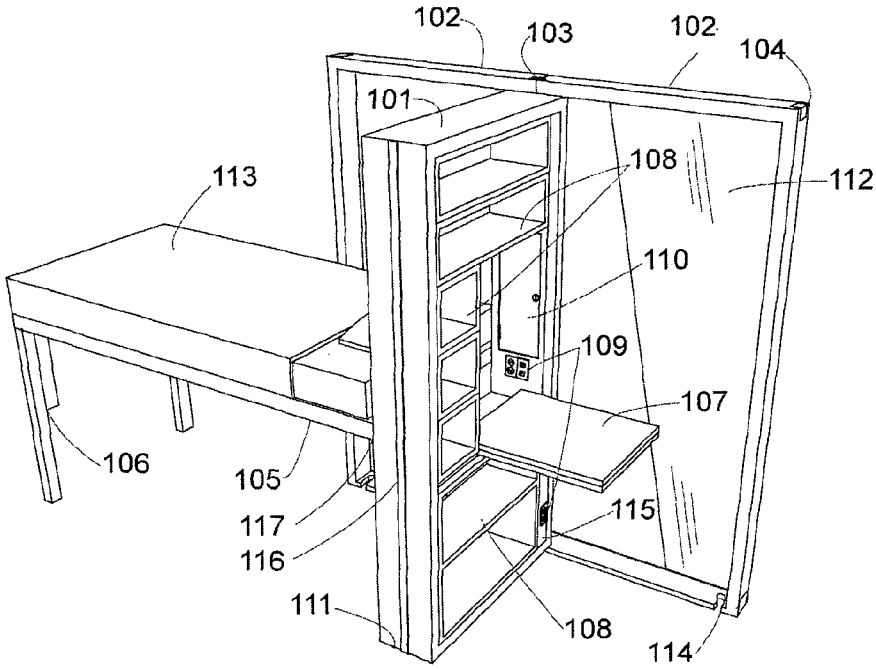
FIG. 1 illustrates the Fold Up Dormitory from the front oblique view after basic deployment of all features.

The"The Fold Up Dormitory;" is intended for use in situations where living and working quarters for a small or large number of people are required on short notice or at irregular intervals. "The Fold Up Dormitory" is a device made of wood, steel and premanufactured hardware, comprising components for sleeping, working and storage of small items. It is mobile, easy to store, simple to operate and offers many options to those who use it.

The several drawings illustrating this invention and its use contain various elements which are denoted with the following reference numerals and written descriptions:

101—Central core
102—Folding frames
103—Hinge for supports
104—Rigid steel corner connections
105—Bed platform
106—Folding legs
107—Foldable desk surface
108—Storage shelving
109—Electrical outlets
110—Secure locker
111—Leveling feet
112—Privacy barrier
113—Mattress or cushion
114—Notch
115—Electrical chase
116—Mounting bracket
117—Bed raising hardware
201—Electrical hookup
202—Steel handle
203—Curtain hooks
204—Heavy duty wheels
1001—Chair
1002—Computer
1501—Repair kit
1502—Bicycle hook w/lock
1503—Mirror
1504—Cup holder
1505—Additional supports for larger, encompassing privacy curtain/bug net/changing area
1506—Drawers to increase functionality of storage
1507—Lighting integrated with electrical chase
1508—Cable/internet data port
1509—Under bed curtain for hiding belongings stowed under bed
1510—Additional hanging hooks
1511—Towel drying rod
1512—Engraved number plaque
1513—Fold-out seat pivotally connected to the central core
1514—Dry erase message panel (e.g., magnetic)
1515—Rat screen TV/computer screen
1516—Microphone and webcam FIG. 1 illustrates the Fold Up Dormitory apparatus from the front oblique view after basic deployment of all features. Bed platform 105 is shown at full height, attached to a first side of central core 101 and oriented in a substantially horizontal plane. Storage units 108 are shown in their basic, default positions (contrast FIG. 10). Desk surface 107 is deployed but not expanded, attached to a second side of central core 101, and oriented in a substantially horizontal plane. Privacy barrier 112 (preferably an opaque curtain) is shown in a cutaway view, attached to a pair of folding frames 102. Also shown is a secure locker 110, central structural core 101, bed raising hardware 117 (such as but not limited to ratchets for raising and lowering the locus of attachment between bed platform 105 and central core 101), external shelving mounting bracket 116, electrical chase 115, electrical outlets 109, a notch 114 built into the folding frames 102 to accommodate adjustable feet 106 when these are folded, and rigid steel connections 104 on the folding frames 102.

Figure 2:
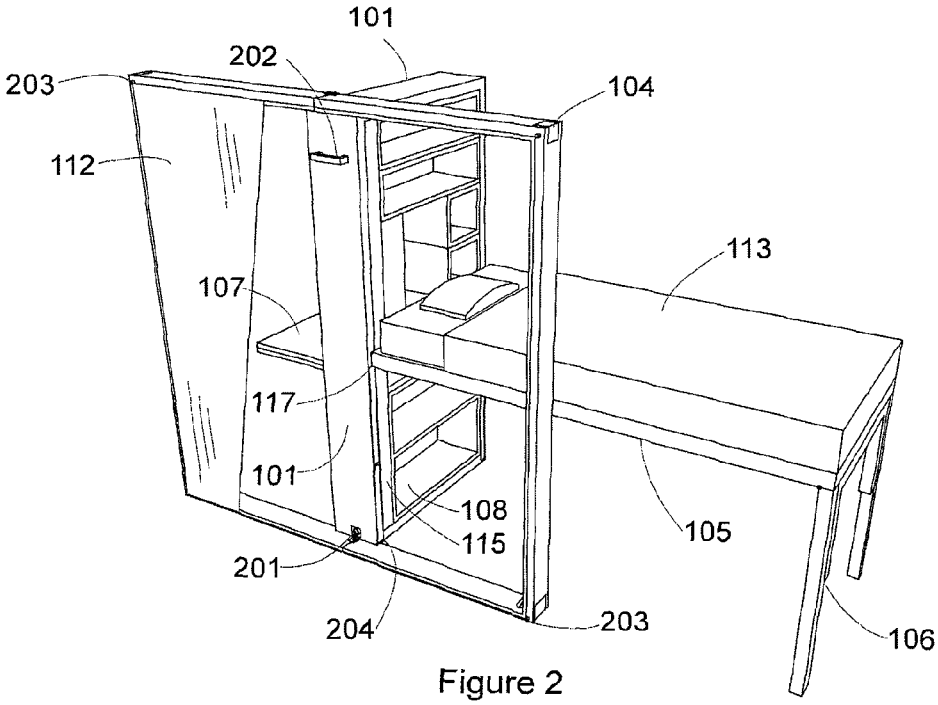
FIG. 2 illustrates the Fold Up Dormitory from the rear oblique view after basic deployment of all features.

FIG. 2 illustrates this same apparatus in the same configuration, from the rear oblique view. Bed platform 105 is shown at full height, storage units are all in their basic default positions, the foldable desk surface 107 is deployed but not fully expanded (again contrast FIG. 10), and the privacy barrier 112 is shown in a cutaway view. Also shown is a single electrical hookup 201 for connection to a power source, sturdy wheels 204 affixed proximate the bottom rear corner of the central core 101, and steel handle 202 affixed to the upper outer rear face of central core 101, for easy movement of the device (see FIG. 14).

FIGS. 3 through 6 illustrate the method by which this Fold Up Dormitory apparatus is converted from a closed configuration for storage to an open configuration for use.

Figure 3:
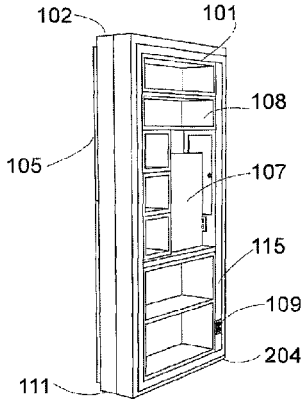
FIG. 3 illustrates the device fully folded in an upright position in a closed configuration for storage.

FIG. 3 illustrates the device fully folded in an upright position for storage. In this configuration, central core 101, frames 102, bed platform 105, desk surface 107, and storage shelving 108 are all are contained within a hexahedronal space not exceeding 24" thick, 45" wide and 81" high, for a single bed configuration. It is important to emphasize that this size limitation is to accommodate a "Long Twin mattress" typical in college dormitories, with dimensions of 36"×80". Other size limits would be based on other standard mattress sizes with the device changing size to roughly match the size of other standard bed sizes. Variations of this device could have maximum dimensions with the length of standard bed size and width (including additional width margin of about 6 inches wider than the mattress size), of "Full size" 54" (+6)× 75", "queen size"60" (+6)×80" or "king 76" (+6)×80".

Figure 4:
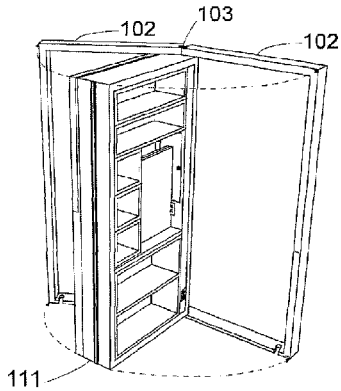
FIG. 4 illustrates folding frames being deployed to stabilize the device for further expansion and use.

FIG. 4 illustrates pair of folding frames 102 made of wood or light gauge steel, on opposite sides of central core 101, being deployed to stabilize the Fold Up Dormitory apparatus for further expansion and use. The folding frames 102 outwardly pivot around a hinge 103 (preferably comprising steel or a strong metal) providing vertical frame-to-core axes of pivotal connection. Adjustable stabilizing feet 111 are adjusted to level the apparatus at this stage of deployment. Folding frames 102 are also used for supporting a privacy barrier 112 which is preferably, but not limited to, a substantially opaque curtain. As an alternative, for example not limitation, folding frames 102 may be fully integrated with a substantially opaque material such as wood, providing privacy barrier 112, though the curtain is preferred because it is of lighter weight.

Figure 5:
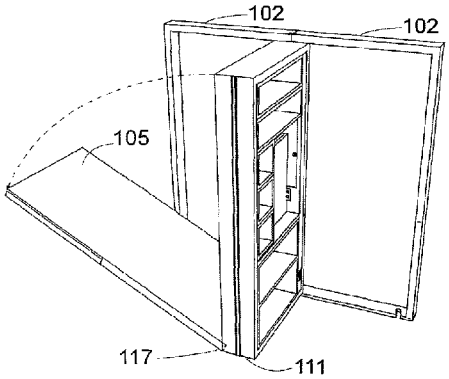
FIG. 5 illustrates the bed platform being deployed.

FIG. 5 illustrates bed platform 105 being deployed with the legs 106 still folded and without the mattress or cushion 113, preferably separately supplied. This deployment occurs by downwardly rotating bed platform 105 about a horizontal bed-to-core axis of pivotal connection. Bed platform 105 may comprise a rigid material such as but not limited to wood, or alternatively, a light, built-in cushion, such as but not limited to a thick foam pad, or a series of bed springs such as are conventionally used in rollaway beds.

Figure 6:
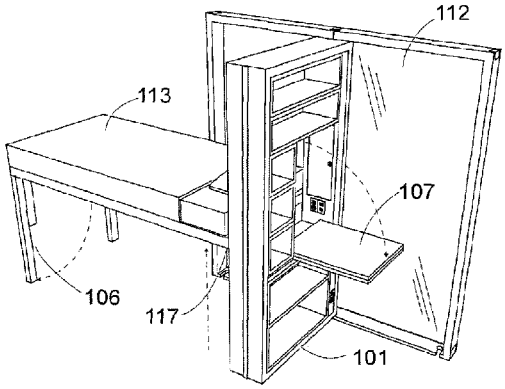
FIG. 6 illustrates the Fold Up Dormitory from the front oblique view after basic deployment of all features.

FIG. 6 illustrates the Fold Up Dormitory from the front oblique view after basic default deployment of all features. Bed platform 105 is shown moved up to full height with a mattress 113 placed thereon, and storage units 108 are in their basic, default positions. Specifically, bed platform 105 can be unlatched, flipped down as in FIG. 5, and then set at one of three heights (FIGS. 5, 6 and 13) using the ratcheting bed raising hardware 117 and the folding legs 106 proximate the foot of the bed platform 105. Desk surface 107 is deployed by downwardly rotating desk surface 107 about a horizontal desk-to-core axis of pivotal connection. As illustrated here, desk surface 107 is not yet not foldably expanded as in FIG. 10. Privacy barrier 112 is now also deployed by attachment to folding frames 102 using curtain hooks 203. The folding frames 102, oriented in a substantially vertical plane, are shown in the open and locked position, attached to central core 101 on one side (the rear side in this view) of bed platform 105 and desk surface 107.

It is important that the conversion just described in FIGS. 3 through 6, between the closed and opened configurations, can be performed by a single individual human without any externally provided motors or power.

To convert the dormitory apparatus from the open configuration for use back to the closed configuration for storage, the steps outlined in FIGS. 3 through 6 are merely reversed.

Figure 7:
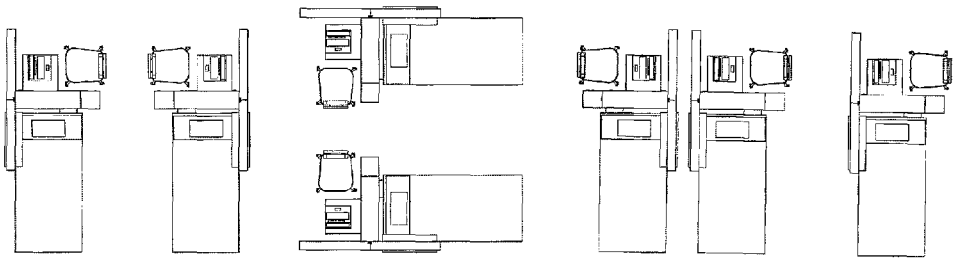
FIG. 7 illustrates from an aerial view, the possible arrangements of more than one of these devices to provide a relative sense of enclosure and privacy for groups of different sizes.

FIG. 7 illustrates from an aerial view, the possible arrangements of more than one Fold Up Dormitory apparatus for accommodating pairs or small groups of people, using the privacy curtain and relative arrangement of apparatus functions to provide a relative sense of enclosure and privacy.

Figure 8:
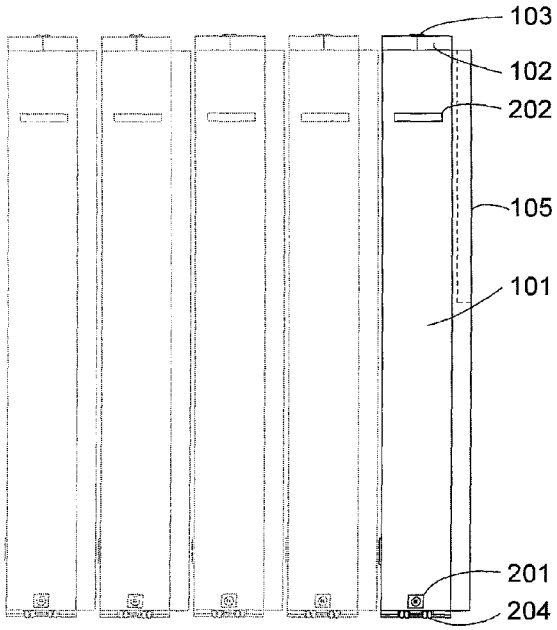
FIG. 8 illustrates five of these devices fully upright and folded in the FIG. 3 configuration, for storage.

FIG. 8 illustrates five fold up dormitories, fully upright and folded in the closed configuration of FIG. 3, for storage. Visible are the sturdy wheels 204, electrical hookup 201, central core 101, folded bed platform 105 without mattress, Steel handle 202, folded supports 102 and hinges 103.

Figure 9:
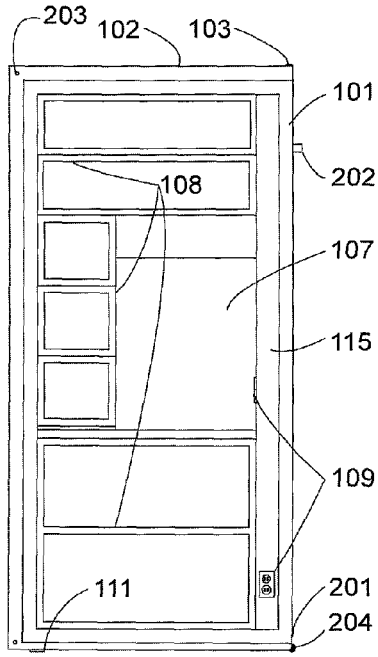
FIG. 9 illustrates the device in closed configuration, fully upright from the side.

FIG. 9 illustrates the apparatus in closed configuration, fully upright from the side, showing how the internal components of the device are fully accessible for cleaning repair or partial use when folded, in the embodiment where privacy barrier 112 comprises a removable curtain.

Figure 10:
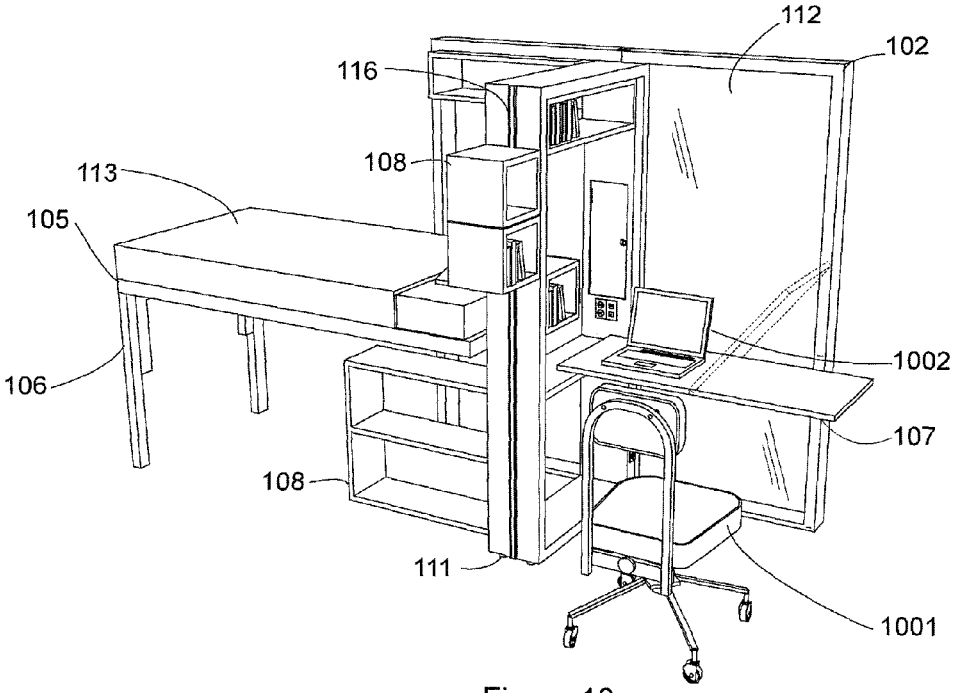
FIG. 10 illustrates the device fully expanded and in use, from a front oblique view.

FIG. 10 illustrates the apparatus fully expanded from a front oblique view. Some of the storage units 108 have been rearranged from their basic, default positions of FIG. 6, and attached to mounting bracket 116 on the outer front face of central core 101. The foldable desk surface 107 has been expanded to its full length after unfolding about a hinged axis (the unfolding is illustrated by the thin-lined desk section shown in intermediate orientation). The apparatus is also shown with a separately-provided laptop computer 1002 and desk chair 1001, merely for illustration of use.

Figure 11:
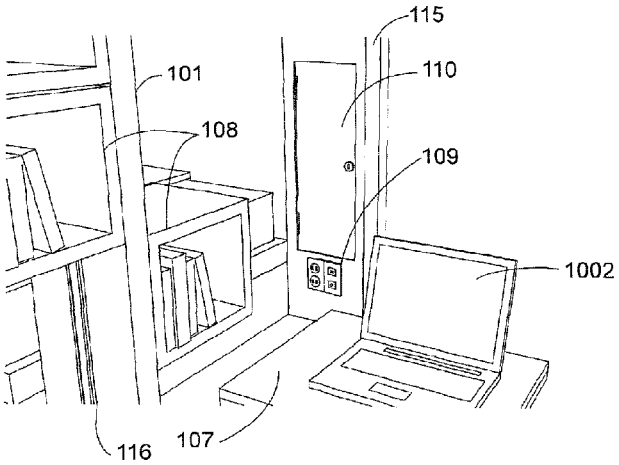
FIG. 11 illustrates a close-up view of the desk and central core area fully expanded and personalized.

FIG. 11 illustrates a close-up view of the desk 107 and central core 101 area fully expanded and personalized with storage rearranged and stocked with personal belongings, together with laptop computer 1002 on desk surface 107, secure locker 110, electrical chase 115 and electrical outlets 109.

Figure 12:
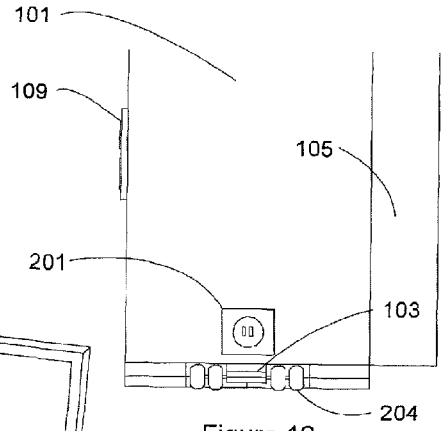
FIG. 12 illustrates a close-up view of the rear base of the device.

FIG. 12 illustrates a close-up view of the rear base of the device showing the sturdy wheels 204, electrical hookup 201, bed platform folded 105, hinge for folding frames 103, electrical outlet 109 and the central structural core.

Figure 13:
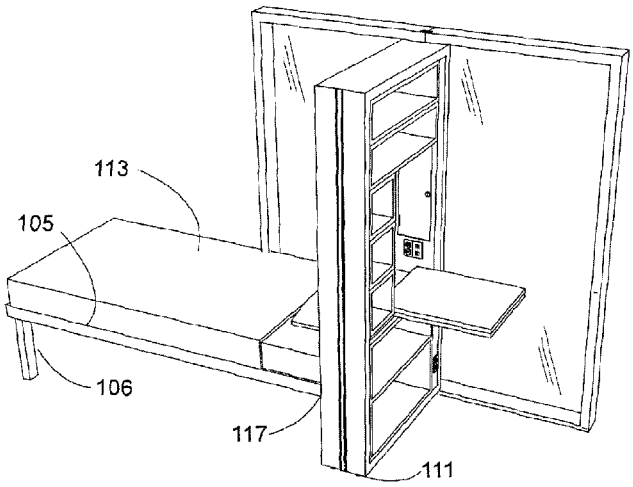
FIG. 13 illustrates the basic functions of the device deployed with the bed platform and legs at their optional lower height.

FIG. 13 illustrates the basic functions of the device deployed with the bed platform and legs at their optional lower height. This setting is achieved by unfolding the short legs 106 and positioning the bed platform 105 with bed raising hardware 117.

Figure 14:
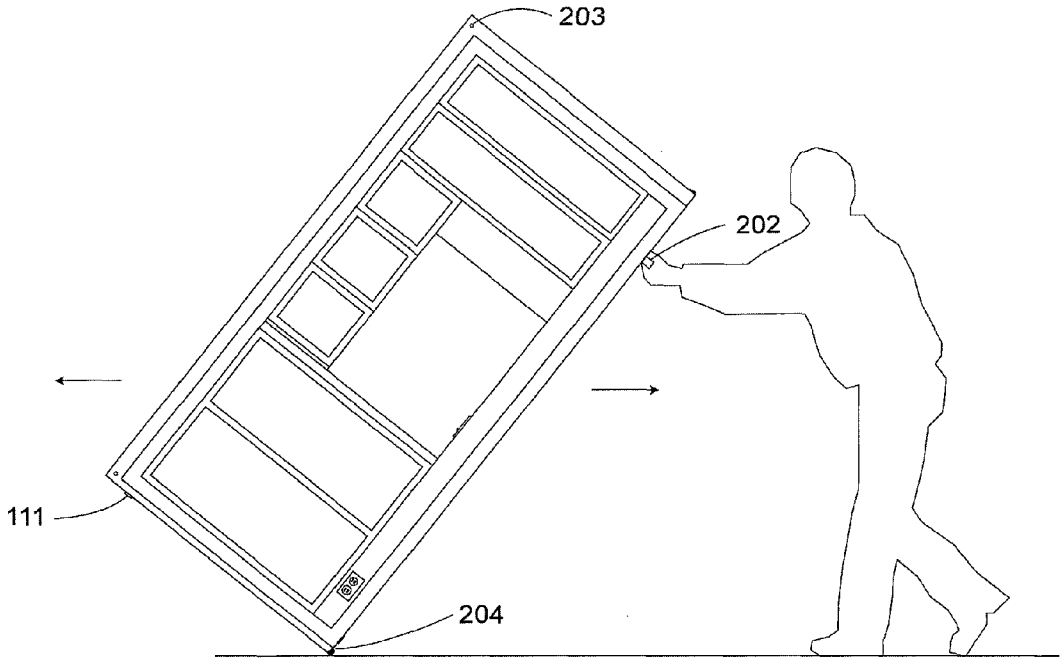
FIG. 14 illustrates the device in the closed configuration being wheeled by an individual for storage or re-positioning.

FIG. 14 illustrates the apparatus being wheeled by an individual for storage or positioning. The locations of the sturdy wheels 204 and steel handle 202 are designed for the apparatus to be tilted back and rolled in this manner by one person by gripping the handle and imparting lateral force. It is important that the device is lightweight enough, and compact enough in this closed configuration, to be moved in this manner by a single person.

Figure 15:
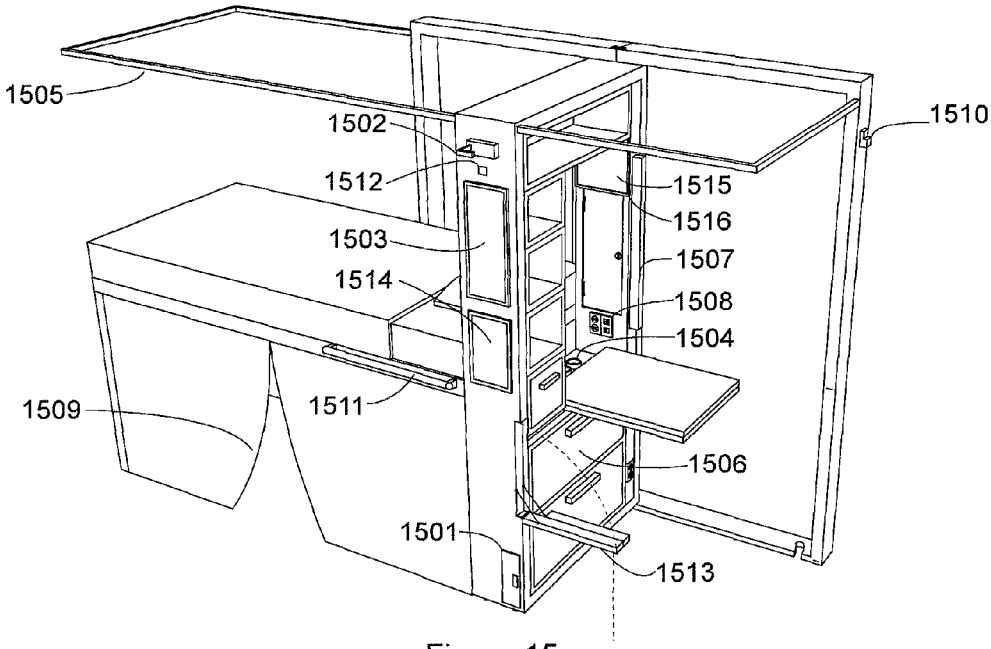
FIG. 15 illustrates the device equipped with numerous accessories designed to maximize functionality.

FIG. 15 illustrates the apparatus outfitted with numerous other optional accessories designed to increase the functionality of the "fold up dormitory." These additional accessories include but are not limited to a repair kit 1501, bicycle hook with lock 1502, durable minor 1503, cup holders 1504, additional supports for a full curtain/bug-net/changing area 1505, Drawers 1506 to increase functionality of storage space, integrated lighting 1507, cable/Internet data port 1508, under-bed curtain for partially obscured storage space 1509, all purpose hooks 1510, towel drying rod 1511, engraved number plaque for administrative purposes or to help provide a temporary address for displaced people using the device 1512, a fold out seat 1513 as an alternative, or in addition to using an external seat pivotally connected with the central core 101, magnetic and dry erase message panel 1514, flat screen television/computer screen 1515 and a built in microphone and web cam 1516 for communication purposes.

Fold out seat 1513, which although optional is a particularly desirable feature for maximizing living comfort and making available basic living necessities, is connected to the second side of said central core 101, for rotation about a horizontal seat-to-core axis of connection, at a height and position in relation to desk surface 107 to provide seating at the desk surface 107. This (downward) rotation about the horizontal seat-to-core axis is illustrated by the broken-line arc in FIG. 15. Given that when in use it must support the weight of a person, seat 1513 is supported by a strong hinge and rotation stop at the junction with central core 101, and is itself preferably fabricated from an unbreakable material such as metal or steel. In one embodiment, it is also supported by at least one cable in tension, illustrated but unnumbered. In another embodiment, it is supported by a fold-out seat support, illustrated by the unnumbered broken straight line toward the lower right of FIG. 15. Other configuration alternatives for strengthening support so that seat 1513 can sustain a person's weight without breakage will be apparent to a person of ordinary skill and are regarded to be within the scope of this discourse and its associated claims.

The Fold Up Dormitory apparatus is intended to convert from the"closed position" for storage into an"open position" for use as living and working space, through a series of simple operations, as earlier described in connection with FIGS. 3-6. In the"closed position" the device resembles an upright bookcase with hexahedronal dimensions of, for example, not limitation, 18" thick×45" wide×81" high, with the length and width not much more than (at least) the length and width of a customary 72"×40" single bed, but a thickness dimension no more than about 24" and preferably no more than 21" and more preferably no more than 18" and most preferably no more than 15", enabling highly compact storage. Small wheels 204 are provided on the bottom rear corner of central core 101 and a sturdy steel handle 202 is provided at a convenient height on the upper outer rear face of central core 101 so the entire apparatus can be tipped back and rolled away by one person (FIG. 14). When closed, many of these devices can be stored together in a relatively small space until they are needed (FIG. 8). When fully opened, the device provides a simultaneously-usable bed platform 105, adjustable shelving 108, an electrical chase 115 with outlets 109 for task lighting, a compact desk 107 and a small secure locker 110 for storing valuables.

The process of transforming the apparatus from the closed position to the open position is quite simple. First the Fold Up Dormitory is moved to the desired location and set down so that it rests on the heavy duty wheels 204 and adjustable feet 111 (FIG. 3). Next the folding frames 102 are opened, fully pivoting around hinges 103 affixed to the central core 101 (FIG. 4). At this point the device is well stabilized and any instability due to uneven ground can be tempered with the adjustable feet 111. The further deployment of various components is dependent on the needs of the user. As noted earlier, bed platform 105 can be unlatched, flipped down and set at one of three heights (FIGS. 5, 6 and 13) using the ratcheting bed hardware 117 and the folding legs 106 proximate the foot of the bed platform 105. (Note from FIG. 5, that when the legs are not use, one of these heights is simply"on the floor.") The desk 107 can be flipped down as in FIG. 6, and if desired can be flipped open, unfolding for a larger working surface as shown in FIG. 10. The storage shelving 108 can be used in its default position inside the structural core 101 or can be rearranged by removing it and attaching it to the shelving mounting brackets 116 on the outside of the core and insides of the folding frames (FIGS. 10 and 11). Personal belongings that need to be kept secure can be locked in the secure locker 110 and personal electronics can be powered with various electrical outlets 109 once the Fold Up Dormitory is connected to a power source via the electrical hookup 201, which electrically connects and distributes power to outlets 109.

Since the Fold Up Dormitory may be used in situations ranging from over-enrollment of students at a university that suddenly needs additional housing, to a disaster where hundreds of people are displaced, there are a number of accessories integrated into the apparatus to enhance its normal function. Accessories include but are not limited to: a privacy barrier 112, shelving 108 with bracketing 116 that can be personalized through various arrangements. Alternative embodiments include but are not limited to versions of the Fold Up Dormitory that sacrifice the work surface for an additional bed platform, storage that provides more security 110 for belongings, and varying different electrical outlets 109 for use in different parts of the world.

The Fold Up Dormitory is specifically designed with a directional bias, meaning that all of the functions are on "one side" of the device allowing the back side, with privacy barrier 112 (preferably a removable opaque curtain) to become a wall that provides some privacy to the user. This feature allows for multiple fold up dormitories to be arranged such that they can accommodate reduced privacy among individuals, pairs or small groups that prefer to cohabitate, while giving more privacy to those who wish to have their own space (FIG. 7). In a large gymnasium, many different arrangements could be achieved providing a sense of personal space, privacy, and choice that is not available in most emergency relief or temporary housing situations.

In contrast to other devices, this invention allows for three bed heights rather than one. When the legs are kept folded, the bed platform 105 sits on the ground. When the small legs 106 are deployed while the long legs remain folded it is low but off the ground. When the longer legs 106 are deployed the bed is raised high off the ground. It should be apparent that an alternative embodiment of this invention could supply more than three possible bed heights. Importantly, the bed and desk are deployed, adjusted, and may be used simultaneously. The Fold Up Dormitory is extremely mobile, and collapses via various pivots discussed above into an optimally small size for storage without disconnecting and reconnecting its various elements.

The desk surface 107 also folds into the core whenever it is not needed, it can be deployed and used regardless of the position of the bed (and vice versa, i.e., the desk can be used absent deployment of the bed), and it has the ability to become a larger or smaller working surface by unfolding or folding as illustrated in FIG. 10. Electrical outlets 109 are integrated into the structure of the Fold Up Dormitory such that one electrical hookup 201 supplies power and multiple electrical devices can therefore be plugged into the provided electrical outlets 109.

The knowledge possessed by someone of ordinary skill in the art at the time of this disclosure is understood to be part and parcel of this disclosure and is implicitly incorporated by reference herein, even if in the interest of economy express statements about the specific knowledge understood to be possessed by someone of ordinary skill are omitted from this disclosure. While reference may be made in this disclosure to the invention comprising a combination of a plurality of elements, it is also understood that this invention is regarded to comprise combinations which omit or exclude one or more of such elements, even if this omission or exclusion of an element or elements is not expressly stated herein, unless it is expressly stated herein that an element is essential to applicants combination and cannot be omitted. It is further understood that the related prior art may include elements from which this invention may be distinguished by negative claim limitations, even without any express statement of such negative limitations herein. It is to be understood, between the positive statements of applicants invention expressly stated herein, and the prior art and knowledge of the prior art by those of ordinary skill which is incorporated herein even if not expressly reproduced here for reasons of economy, that any and all such negative claim limitations supported by the prior art are also considered to be within the scope of this disclosure and its associated claims, even absent any express statement herein about any particular negative claim limitations.

Finally, while only certain preferred features of the invention have been illustrated and described, many modifications, changes and substitutions will occur to those skilled in the art. It is, therefore, to be understood that the appended claims are intended to cover all such modifications and changes as fall within the true spirit of the invention.

I claim:

1. A Fold Up Dormitory apparatus convertible between a closed configuration for storage and an open configuration for use, comprising:

a central core;

a pair of folding frames, each pivotally connected to said central core on opposite sides thereof, for rotation about vertical frame-to-core axes of connection;

a bed platform pivotally connected to a first side of said central core, for rotation about a horizontal bed-to-core axis of connection;

a desk surface pivotally connected to a second side of said central core, for rotation about a horizontal desk-to-core axis of connection; and storage shelving within said central core; wherein:

a) when said apparatus is compacted into said closed configuration for storage, said central core, said frames, said bed platform, said desk surface, and said storage shelving are all are contained within a hexahedronal space not exceeding 24" thick, 45" wide and 81" high;

b) when said apparatus is expanded into said open configuration for use:

said folding frames are attached to said central core on one side of said bed platform and said desk surface and are substantially perpendicular to said first and second side, and are oriented in a substantially vertical plane;

said bed platform is attached to said first side of said central core and oriented in a substantially horizontal plane;

said desk surface is attached to said second side of said central core and oriented in a substantially horizontal plane, and is simultaneously usable together with said bed platform; and said storage shelving is accessible for use simultaneously with said bed platform and said desk surface; and:

c) said apparatus is configured such that all of said folding frames, said bed platform and said desk surface remain pivotally connected to said central core without disconnection, while said apparatus is compacted into said closed configuration for storage, while said apparatus is expanded into said open configuration for use, and while said apparatus is converted between said closed configuration for storage and said open position for use.

2. The apparatus of claim 1, said pair of folding frames further comprising a substantially opaque material providing a privacy barrier.

3. The apparatus of claim 1, said pair of folding frames further comprising a removable, substantially opaque curtain, wherein:

said substantially opaque curtain hangs from said pair of folding frames when said apparatus is expanded into said open configuration for use, thereby providing a privacy barrier.

4. The apparatus of claim 1, said desk surface further comprising a hinged axis for converting between a folded and an unfolded desk surface configuration, by rotation about said hinged axis.

5. The apparatus of claim 1, further comprising:

at least one pair of folding legs for supporting a foot of said bed platform at an elevated height above the ground; and the connection of said bed platform to said first side of said central core further comprising an apparatus for raising and lowering a locus of attachment between said bed platform and said central core; wherein:

said folding legs in combination with said apparatus for raising and lowering provide a substantially level orientation for said bed platform at said elevated height.

6. The apparatus of claim 1, said central core further comprising a plurality of electrical outlets powered by a single electrical hookup to a power source.

7. The apparatus of claim 1, said central core further comprising a secure locker for storing valuables.

8. The apparatus of claim 1, further comprising:

wheels affixed proximate a bottom rear corner of said central core; and a handle affixed to an upper outer rear face of said central core; wherein:

said apparatus, in said closed configuration for storage, is easily moved by tilting said apparatus onto said wheels in combination with gripping said handle and imparting lateral force.

9. The apparatus of claim 1, further comprising shelving mounting brackets affixed to an outer front face of said central core for attaching at least some of said storage shelving to said outer front face.

10. The apparatus of claim 1, further comprising a seat pivotally connected to said second side of said central core, for rotation about a horizontal seat-to-core axis of connection, at a height and position in relation to said desk surface to provide seating at said desk surface.

11. The apparatus of claim 1, omitting any type of external power to convert between said closed configuration for storage and said open configuration for use, except as provided by a human being.

12. A method of providing a temporary living space using a Fold Up Dormitory apparatus convertible between a closed configuration for storage and an open configuration for use, comprising:

a) providing said Fold Up Dormitory apparatus comprising a central core comprising storage shelving therewithin, a pair of folding frames, a bed platform, a desk surface, and storage shelving within said central core, all compacted into said closed configuration for storage so as to be contained within a hexahedronal space not exceeding 24" thick, 45" wide and 81" high;

b) expanding said Fold Up Dormitory apparatus into said open configuration for use, by:

outwardly rotating each of said pair of folding frames on opposite sides of said central core, about vertical frame-to-core axes of pivotal connection between said folding frames and said central core;

downwardly rotating said bed platform about a horizontal bed-to-core axis of pivotal connection between said bed platform and a first side of said central core; and downwardly rotating said desk surface about a horizontal desk-to-core axis of pivotal connection between said desk surface and a second side of said central core; wherein:

c) once said apparatus is expanded into said open configuration for use:

said folding frames are attached to said central core on one side of said bed platform and said desk surface and are substantially perpendicular to said first and second side, and are oriented in a substantially vertical plane;

said bed platform is attached to said first side of said central core and oriented in a substantially horizontal plane;

said desk surface is attached to said second side of said central core and oriented in a substantially horizontal plane, and is simultaneously usable together with said bed platform; and said storage shelving is accessible for use simultaneously with said bed platform and said desk surface; and wherein:

d) said folding frames, said bed platform and said desk surface remain pivotally connected to said central core without disconnection while said apparatus is compacted into said closed configuration for storage, while said apparatus is expanded into said open configuration for use, and while said apparatus is converted between said closed configuration for storage and said open position for use.

13. The method of claim 12, further comprising compacting said Fold Up Dormitory apparatus back into said closed configuration for storage by:

upwardly rotating said desk surface about a horizontal desk-to-core axis of pivotal connection between said desk surface and a second side of said central core;

upwardly rotating said bed platform about a horizontal bed-to-core axis of pivotal connection between said bed platform and a first side of said central core; and inwardly rotating each of said pair of folding frames on opposite sides of said central core, about vertical frame-to-core axes of pivotal connection between said folding frames and said central core.

14. The method of claim 12, said pair of folding frames further comprising a substantially opaque material providing a privacy barrier.

15. The method of claim 12, further comprising hanging a removable, substantially opaque curtain from said pair of folding frames when said Fold Up Dormitory apparatus is expanded into said open configuration for use, thereby providing a privacy barrier.

16. The method of claim 12, further comprising converting said desk surface between a folded and an unfolded desk surface configuration, by rotating about a hinged axis therefor.

17. The method of claim 12, further comprising providing a substantially level orientation for said bed platform at an elevated height above the ground, by:

unfolding at least one pair of folding legs for supporting a foot of said bed platform at said elevated height; and in combination with said unfolding, raising a locus of attachment between said bed platform and said central core using a raising and lowering apparatus therefor.

18. The method of claim 12, further comprising powering a plurality of electrical outlets of said central core further by a single electrical hookup to a power source.

19. The method of claim 12, further comprising storing valuables in a secure locker of said central core.

20. The method of claim 12, further comprising easily moving said Fold Up Dormitory apparatus, in said closed configuration for storage, by:

tilting said Fold Up Dormitory apparatus onto wheels affixed proximate a bottom rear corner of said central core; and in combination with said tilting, gripping a handle affixed to an upper outer rear face of said central core and imparting lateral force.

21. The method of claim 12, further comprising attaching at least some of said storage shelving to an outer front face of said central core, using shelving mounting brackets affixed to said outer front face.

22. The method of claim 12, further comprising provide seating at said desk surface by rotating a seat pivotally connected to said second side of said central core at a height and position in relation to said desk surface, about a horizontal seat-to-core axis of connection.

23. The method of claim 12, further comprising for converting between said closed configuration for storage and said open configuration for use using only force provided by a human being, and omitting any other type of external power.

* * * * *